US009605423B2

(12) United States Patent
Cogburn

(10) Patent No.: US 9,605,423 B2
(45) **Date of Patent: *Mar. 28, 2017**

(54) METHOD OF BASEMENT CONSTRUCTION

(71) Applicant: John Cogburn, Quinlan, TX (US)

(72) Inventor: John Cogburn, Quinlan, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/936,061

(22) Filed: Nov. 9, 2015

(65) Prior Publication Data

US 2016/0060858 A1 Mar. 3, 2016

Related U.S. Application Data

(60) Division of application No. 14/149,175, filed on Jan. 7, 2014, now Pat. No. 9,181,690, which is a continuation of application No. 13/790,860, filed on Mar. 8, 2013, now Pat. No. 8,650,830.

(51) Int. Cl.

| | |
|---|---|
| ***E04H 9/08*** | (2006.01) |
| ***E04B 1/00*** | (2006.01) |
| ***E02D 27/01*** | (2006.01) |
| ***E04B 1/16*** | (2006.01) |

(52) U.S. Cl.

CPC ..... *E04B 1/0007* (2013.01); *E02D 27/01* (2013.01); *E04B 1/161* (2013.01); *E04H 9/08* (2013.01)

(58) Field of Classification Search

CPC . E04B 1/0007; E04B 1/04; E04H 9/12; E04H 9/08; E04H 9/14

USPC .. 52/302.1, 294, 169.1, 169.5, 169.6, 169.8, 52/197, 81.6

See application file for complete search history.

(56) References Cited

U.S. PATENT DOCUMENTS 2,464,491 A * 3/1949 Davis ..... E02D 31/02 52/197
3,182,374 A * 5/1965 Cook ..... E04G 11/22 249/20
3,596,419 A * 8/1971 Jalbert ..... E04H 13/00 52/137
4,239,416 A * 12/1980 Borca ..... B65G 5/00 220/62.21
4,488,392 A * 12/1984 Pearcey ..... E04B 1/3211 264/32
4,805,360 A * 2/1989 Kuehnl ..... E04H 9/12 52/169.1
5,094,044 A * 3/1992 Dykmans ..... B65D 88/34 156/143
5,106,229 A * 4/1992 Blackwell ..... E02D 31/10 4/506
5,115,613 A * 5/1992 McCarthy ..... E04H 9/12 109/1 S
5,239,794 A * 8/1993 Klein ..... E03B 11/00 210/170.01
5,315,794 A * 5/1994 Pearson ..... H02B 7/06 52/169.6
5,408,793 A * 4/1995 Dykmans ..... B65D 88/34 156/143
5,481,837 A * 1/1996 Minks, Jr. ..... E04H 9/14 52/169.6
6,085,475 A * 7/2000 Parks ..... E04H 9/12 52/169.14
6,131,343 A * 10/2000 Jackson, Jr. ..... E04H 9/14 52/169.6
6,385,919 B1 * 5/2002 McCarthy ..... E04H 9/14 109/1 S
6,385,920 B1 * 5/2002 Chandler ..... E04H 9/12 52/169.6
6,434,896 B1 * 8/2002 Mitchell ..... B29C 41/06 52/169.6
6,719,492 B1 * 4/2004 Heierli ..... E02D 29/05 405/124

(Continued)

FOREIGN PATENT DOCUMENTS

JP 02074727 A * 3/1990 ..... E02D 29/00

*Primary Examiner* — Brent W Herring

(74) *Attorney, Agent, or Firm* — Vincent J. Allen; Carstens & Cahoon, LLP

(57) ABSTRACT

A method of constructing an inhabitable underground structure is disclosed that comprises the steps: creating a cutout in the earth at a desired location to generally match a desired shape of an interior of the underground structure; applying a reinforcement structure to an outer perimeter of the cutout; and applying shotcrete over the reinforcement structure to create a monolithic underground structure.

6 Claims, 3 Drawing Sheets

(56) References Cited

U.S. PATENT DOCUMENTS

| | | | | |
|---|---|---|---|---|
| 7,017,309 | B2 * | 3/2006 | McNett | E02D 31/02 52/169.14 |
| 7,856,762 | B2 * | 12/2010 | Deisenroth | B60N 2/4242 52/143 |
| 8,650,830 | B2 * | 2/2014 | Cogburn | E04B 1/0007 52/169.6 |
| 9,181,690 | B2 * | 11/2015 | Cogburn | E04B 1/0007 |
| 9,388,564 | B2 * | 7/2016 | Ros Garcia | E04H 15/56 |
| 2002/0062615 | A1 * | 5/2002 | Gibson | E02D 27/02 52/649.1 |
| 2009/0241442 | A1 * | 10/2009 | MacLean | A01K 1/0103 52/220.3 |
| 2012/0198778 | A1 * | 8/2012 | MacLean | A01K 1/0103 52/173.1 |
| 2013/0036682 | A1 * | 2/2013 | Thrasher | E02D 31/002 52/166 |
| 2014/0250803 | A1 * | 9/2014 | Cogburn | E04B 1/0007 52/169.6 |
| 2015/0368893 | A1 * | 12/2015 | Ros Garcia | E04H 15/56 52/63 |
| 2016/0060858 | A1 * | 3/2016 | Cogburn | E04B 1/0007 52/741.15 |

* cited by examiner

METHOD OF BASEMENT CONSTRUCTION

PRIORITY CLAIM

This application is a Divisional of U.S. application patent application Ser. No. 14/149,175 filed Jan. 7, 2014, which is a Continuation of U.S. Pat. No. 8,650,830 filed Mar. 8, 2013 and issued Feb. 18, 2014, which is incorporated herein by reference in its entirety.

BACKGROUND

1. Field of the Invention

This invention relates to a method of constructing an underground structure, and more particularly to a method of construction of a basement that can be used as a foundation for the upper portion of the house.

2. Description of the Related Art

Basements have traditionally been constructed using either a concrete formed structure or a cinder block construction method, both of which involve extensive labor and increase the cost substantially compared to the construction cost of a typical slab foundation. Builders often lament that it is cheaper to go up than down. Nevertheless, there are some benefits to having a basement, particularly in climates or geographic regions where tornados or other weather events are likely to be encountered.

In certain parts of the country and the world, basements are almost non-existent because of conditions such as soil type. Clay soil, for example, has the tendency to expand when wet, applying significant pressure to the walls of the basement that can cause cracking or movement of the basement wall. For the same reason, the structure of the basement may shift relative to other parts of the structure because it is typically made of different component parts. Generally, the floor of the basement is usually poured first and the walls of the basement are typically poured on top of the floor after the floor has set.

There is a need for a new method of constructing a basement or other underground structure that is both cost efficient and reliable. It would be desirable to have such a structure that is easy to construct and is comparable in cost to pouring a traditional concrete slab foundation. It would also be desirable for the structure to be such that water and moisture present in the basement are kept to a minimum.

SUMMARY

This summary is provided to describe certain aspects of exemplary embodiments that can be practiced. It is not intended to show the essential features of the invention, nor is it intended to limit the scope of the claims of any issued patent.

In one exemplary embodiment, an underground structure is constructed using the steps: creating a cutout in the earth at a desired location to generally match a desired shape of an interior of the underground structure; applying a reinforcement structure to an outer perimeter of the cutout; and applying shotcrete over the reinforcement structure to create a monolithic underground structure.

DETAILED DESCRIPTION

Figure 1:
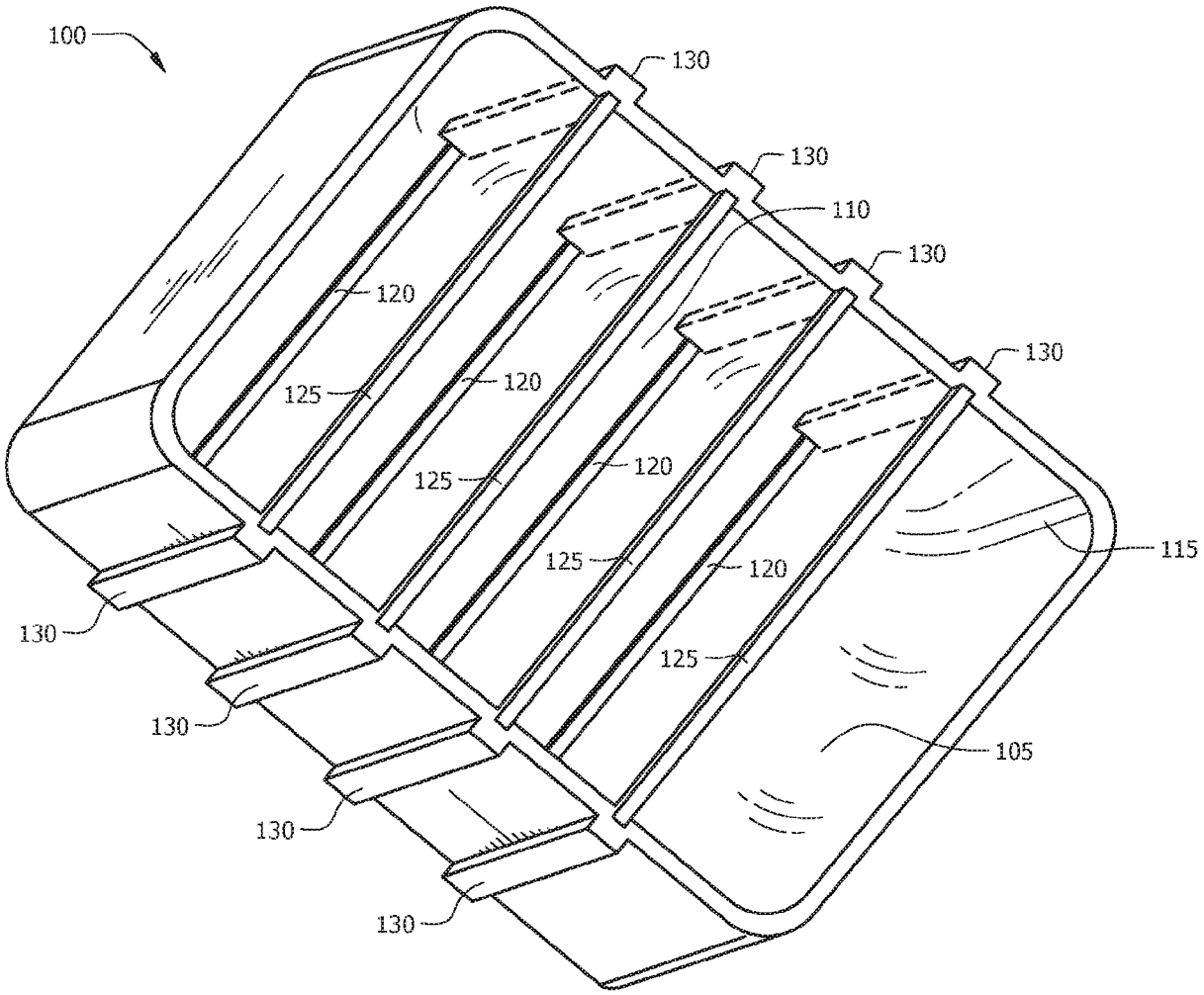
FIG. 1 is a perspective view of an underground structure in accordance with an exemplary embodiment of the invention.

Referring now to FIG. 1, a perspective view of an underground structure in accordance with an exemplary embodiment of the invention is illustrated. The underground structure 100 is constructed from shotcrete reinforced with traditional rebar, steel mesh and/or fibers. Shotcrete is pneumatically applied concrete and can be applied using either a wet mix or a dry mix. The term "gunite" is often used in the industry to refer to the dry-mix shotcrete process in which the dry cementious mixture is blown through a hose to the nozzle, with water being injected at the nozzle immediately before it exits the nozzle. The dry-mix process allows for effective placement in overhead and vertical applications.

In one embodiment of the invention, the corners 105, 110, 115 of the underground structure 100 are all rounded, including the transitions between the walls and the floor. Moreover, the floor is also rounded such that a cross section of the floor can form the shape of an inverted arch to provide a more even distribution of the weight supported by the walls of the structure through the floor of the structure.

To build the structure shown in FIG. 1, first a hole is excavated in the ground generally in the shape desired for the underground structure. Although a rectangular shape is illustrated, the desired shape could be any shape desired by the end user although it is preferred that all corners are rounded to avoid stress concentrations. Rebar or other reinforcing means such as synthetic fiber is placed in the structure along the walls and the floor of the structure to provide reinforcement and to serve as a guide for how thick the shotcrete should be applied. A separate wire or string can also be used to mark the inner surface of the underground structure to ensure that the walls and floor are of sufficient thickness to support the loads for a given project. The rebar is formed in curved shapes to match the desired end shape of the structure. Ideally, the re-bar should be constructed of one piece through the walls and floor of the structure and/or should be secured together to effectively create a single piece.

Several cutouts may also be formed in the structure to provide a means of supporting both the floor beams 120 and the ceiling beams 125 of the underground structure. Additionally, cutouts in the sidewalls of the walls of the hole cut in the ground can be created such that pilasters 130 are formed behind where the ceiling joist and floor joist will be located to provide additional strength. The size of the rebar and the thickness of the shotcrete to be applied can be varied to meet the specific structural requirements. Although not shown, a plurality of pipes can be inserted through the walls and the floor at desired locations to allow for the creation of weep holes for the purpose of allowing water to weep into the interior of the underground structure so that it can be collected and drained into a suitable sump.

After the reinforcement structure is in place, dry concrete is pneumatically applied to the structure through a nozzle that mixes the concrete with water. A plaster can be applied to the inner surfaces of the concrete to smooth out imperfections or alternatively can be left as is. The structure can be completed in a single application or multiple applications could be utilized if a composite wall is desired.

Figure 2:
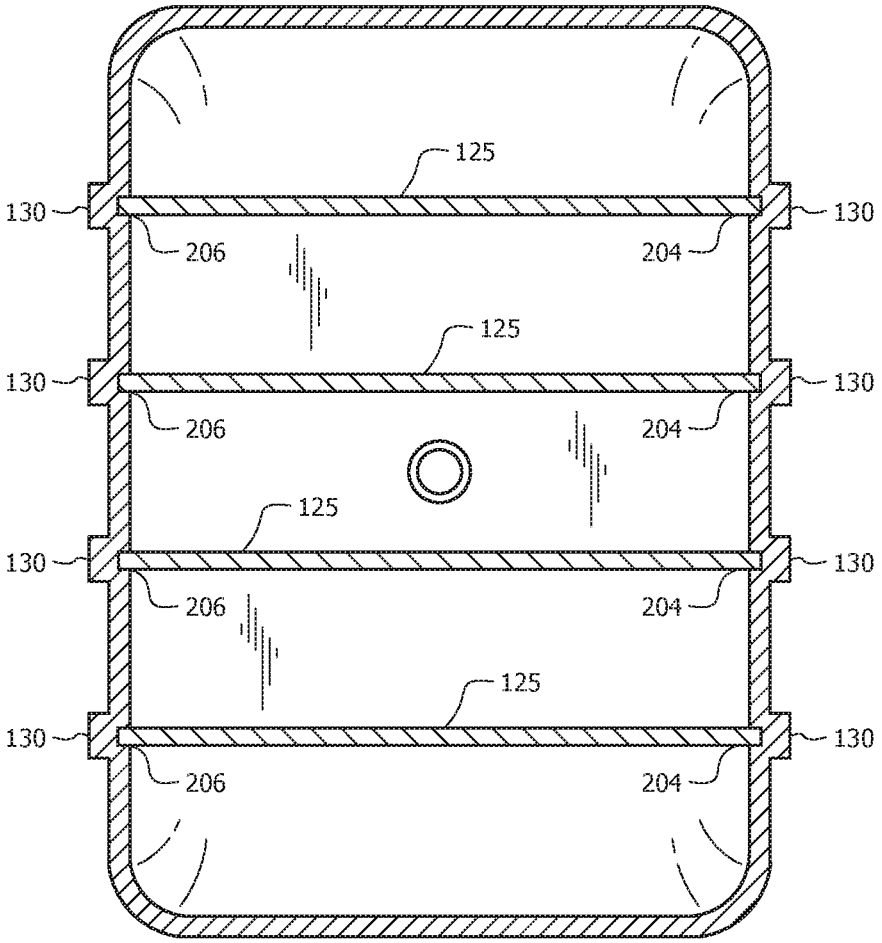
FIG. 2 is a top view of an underground structure in accordance with an exemplary embodiment of the present invention.

Referring now to FIG. 2, a top view of an underground structure in accordance with an exemplary embodiment of the present invention is illustrated. Wood beams 125 can be placed across the underground structure by cutting the wood beam to fit between the cutouts 204 and 206. The wood beams can rest on a traditional stud wall that is placed inside the underground structure (not illustrated) to support the ceiling of the basement and the floor of the above-ground structure. Alternatively the beams can rest on the ledge of the cutouts 204, 206. The purpose of the pilasters 130 in FIG. 2 is to provide additional strength at the area which will receive more of the load as a result of the beams. This allows the structure to have an effective increased thickness, thus creating a stronger structure. Alternatively, the thickness of the entire underground structure could be increased to support the desired load.

Figure 3:
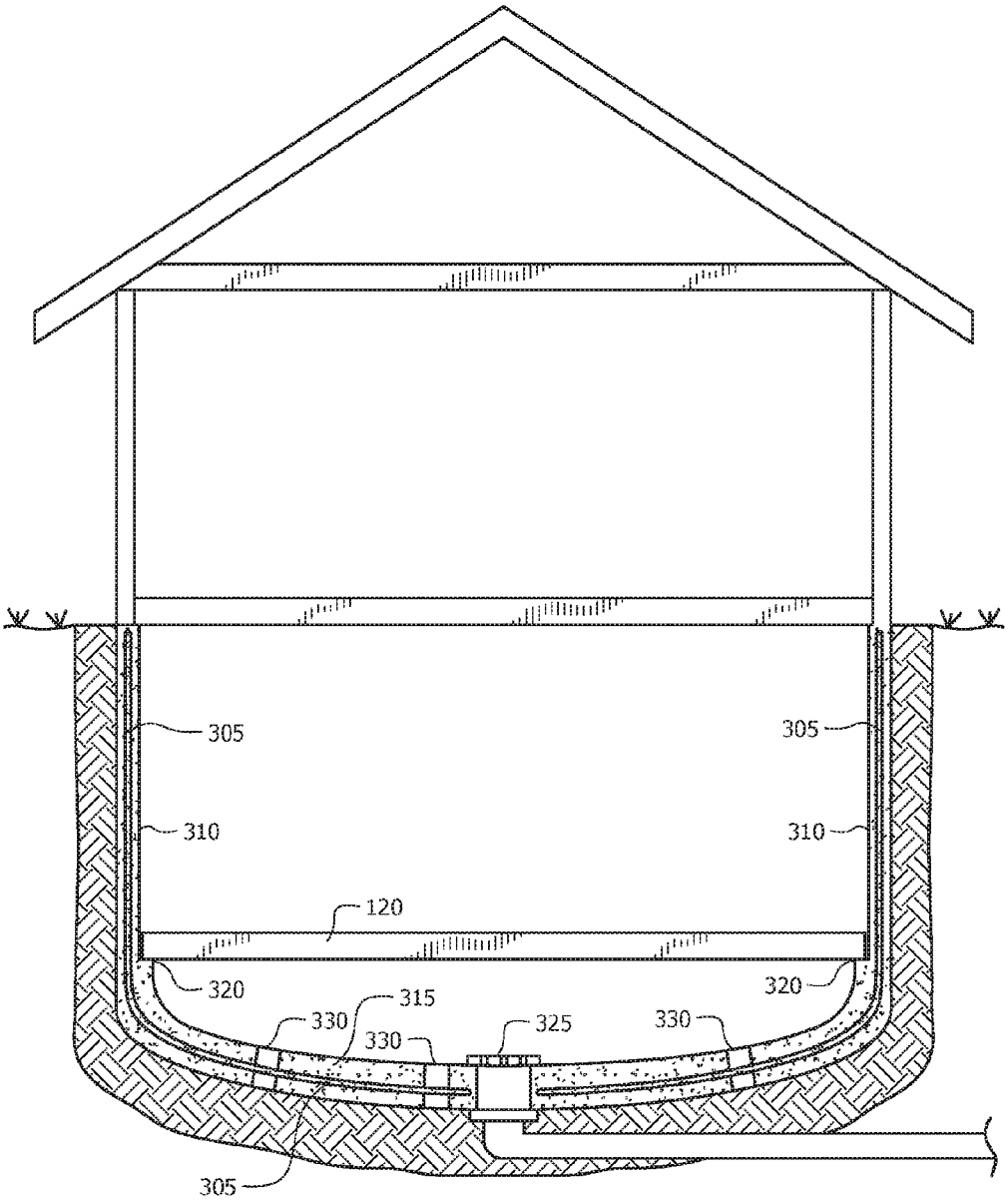
FIG. 3 is a cross-sectional view of an underground structure used as a foundation for a house in accordance with an exemplary embodiment of the invention.

Referring now to FIG. 3, a cross-sectional view of the underground structure 100 is illustrated. The structure having rebar 305 placed within it has generally upright walls 310 that are connected to an inverted arch-shaped bottom 315. The inverted arch 315 provides better distribution of weight than a structure with a slab or footings for this purpose. Alternatively, the structure could be made with a flat bottom having rounded corners underneath the walls depending on the weight that must be supported by the walls. Floor beams 120 can be placed across the bottom of the structure and supported by ledges 320 formed in the structure that keep the floor beams spaced away from the bottom structure of the basement. The ledges can be sloped to help prevent the accumulation of moisture underneath the beams. The edges of the beams can also be spaced away from the wall to further aid in avoiding the accumulation of moisture. In this manner, water that runs along the inside walls of the basement structure and collects at a low point in the bottom of the basement structure, which can then be drained using a sump through the drain 325. Alternatively, a sump pump can be placed at the lowest point of the structure to evacuate water to a drain line.

To help prevent "floating" of the underground structure, weep holes 330 can be placed in the bottom of the structure to allow water that collects underneath the structure to move to the inside of the structure where it can be drained away by the drain or a sump pump. The weep holes in one embodiment can be placed at the center of the bottom of the structure as well as at a distance of approximately 6 feet from each wall.

In addition to using the underground structure for traditional home construction, the underground structure could also be placed underneath or adjacent a mobile home to allow a storm shelter for someone who resides in a mobile home. The structure could also be used in a stand-alone manner near an existing home. So instead of providing ceiling beams for building up structure from the top of the basement structure, a waterproof top can be placed on the structure with an opening that allows the occupant of the mobile home to enter the underground stricture in the event of a storm.

Shotcrete is traditionally made at the construction site. Sand and portland cement are mixed together and a machine is used to shoot the mixture onto the wall. The mixture can be semi-dry compared to pouring a traditional concrete foundation. This typically results in a stronger structure because less water in the concrete mixture generally results in a stronger structure once the mixture has cured. There is also a tendency when pouring traditional foundations and walls to wet the mixture after it arrives at the site to make it easier to pour even though this is not a recommended practice. When it does happen, it results in structures that are weaker than specified and the consequent foundation cracking problems.

By utilizing the reinforced shotcrete construction method disclosed herein, home builders can save significant money in the construction of a basement. This would lead to more home owners choosing to build a basement because it has benefits that are not available in homes without such a basement and the cost of going down into the ground to build additional living structures is now significantly cheaper.

While various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called field. Further, a description of a technology in the "Background" is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

The invention claimed is:

1. A method of constructing an inhabitable underground structure comprising the steps:

creating a cutout in the earth at a desired location to generally match a desired shape of an interior of the underground structure;

applying a reinforcement structure to the cutout, the reinforcement structure having one or more transitions comprising concave curvatures for connecting a plurality of walls of the reinforcement structure to a bottom of the reinforcement structure;

applying shotcrete over the reinforcement structure to create a monolithic underground structure;

using a top side of the monolithic underground structure as a foundation to support an above ground structure; and placing a plurality of floor beams across a floor of the underground structure by mounting the plurality of floor beams above a bottom of the underground structure such that a resulting finished floor of the underground structure is spaced apart from the bottom of the underground structure to allow for draining of moisture between the finished floor and the bottom of the monolithic structure.

2. The method of claim 1 wherein a bottom of the underground structure is shaped generally in the form of an inverted arch.

3. The method of claim 1 wherein the reinforcement structure is formed using rebar.

4. The method of claim 1 wherein the reinforcement structure is formed using fiber mesh.

5. The method of claim 1 wherein the shotcrete is applied using a dry mix process.

6. The method of claim 1 wherein the bottom of the reinforcement structure is substantially flat.

* * * * *